United States Patent [19]

Luery

[11] Patent Number: 4,800,602

[45] Date of Patent: Jan. 31, 1989

[54] SIZE ADJUSTABLE BEACH TOWEL AND METHOD

[76] Inventor: Jerry L. Luery, 9245 Countess Dr., Owings Mills, Md. 21117

[21] Appl. No.: 156,417

[22] Filed: Feb. 16, 1988

[51] Int. Cl.[4] ..... A47G 9/06

[52] U.S. Cl. ..... 5/417; 24/140; 24/573

[58] Field of Search ..... 5/417, 418, 419, 420, 5/482, 486, 496; 24/140, 573

[56] References Cited

U.S. PATENT DOCUMENTS

| | | | |
|---|---|---|---|
| 1,158,356 | 10/1915 | Wilson . | |
| 1,267,042 | 5/1918 | Arnold . | |
| 1,281,692 | 10/1918 | Stonebridge . | |
| 2,808,596 | 10/1957 | Schreiner | 5/482 |
| 2,840,092 | 6/1958 | Hill . | |
| 2,863,467 | 12/1958 | Hearell . | |
| 2,939,468 | 6/1960 | Boyce . | |
| 3,103,050 | 9/1963 | Reitmeier . | |
| 3,237,904 | 3/1966 | Abruzese | 5/417 |
| 3,242,509 | 3/1966 | Nissen | 5/420 |
| 3,273,176 | 9/1966 | Millar | 5/487 |
| 3,805,816 | 4/1974 | Nolte . | |
| 4,005,499 | 2/1977 | Klein . | |
| 4,231,125 | 11/1980 | Titl | 5/419 |
| 4,512,049 | 4/1985 | Henry | 5/417 |
| 4,620,396 | 11/1986 | Bjorntwedt | 52/3 |
| 4,631,765 | 12/1986 | Casey | 5/417 |

*Primary Examiner*—Alexander Grosz

*Attorney, Agent, or Firm*—Wegner & Bretschneider

[57] ABSTRACT

A beach towel is formed of a number of towel modules. Each module includes at least two openings along at least one edge. The individual modules are joined by flexible members passing through the openings. The ends of the flexible members are provided with readily detachable connectors so that the ends of each flexible member may be joined to form a loop.

11 Claims, 2 Drawing Sheets

SIZE ADJUSTABLE BEACH TOWEL AND METHOD

By this invention, beach towel modules are readily connected together, and readily detached from one another, to adjust surface area depending on individual needs and preferences.

Beach towel modules can be used alone or connected to one another. When used individually, the entire surface area of a beach towel module is available to the user without restriction or discomfort. When used together, beach towel modules are fastened together using a system which is unobtrusive to the user of the beach towel.

BRIEF SUMMARY OF THE INVENTION

The invention concerns a detachable beach towel and a method to increase the surface area of a beach towel. Each beach towel module contains at least two regularly-spaced linear openings having at least two of the regularly-spaced linear openings along at least one outermost edge of the beach towel module. The two linear openings define a linear axis extending parallel to the nearest outermost edge. When connected, the beach towel modules are oriented such that at least two paired linear openings of a first and a second beach towel module are in direct opposing relationship with one another.

Two flexible members join the beach towel modules together. A flexible member terminates in a first end and a second end; the ends being provided with complementary connecting means capable of being readily detached. The width of the flexible member is less than the length of the linear openings. The length of said flexible member is greater than twice the distance from the outermost edge of the connected beach towel modules to the linear axis.

A first beach towel module is attached to said second beach towel module by at least two connected flexible members, each flexible member extending through a linear opening of the first beach towel module and the directly opposing linear opening of the second beach towel module. The connected beach towel modules are capable of ready detachment by the release of the complementary connecting means.

DETAILED DESCRIPTION OF THE INVENTION

A beach towel module of this invention can be used alone or can be connected to a second beach towel module to increase available towel surface area.

Ideally, a beach towel module of this invention is of an absorbent material and of a size convenient for use unconnected to any other beach towel module. Generally, smaller beach towel modules are more convenient to launder, store, transport, and the like; on the other hand, larger sized beach towel modules are more preferred to lay upon and for drying oneself after bathing. It is preferred that a beach towel module of this invention be of an intermediate size to meet both types of requirements. The most preferred beach towel module size is 30 inches by 60 inches.

Two or more beach towel modules can be connected to form a larger contiguous towel, comfortable for resting, sitting, or laying upon. Connected beach towel modules can also be used after bathing or as a blanket for warmth. Other uses of beach towel modules, whether connected or unconnected, will be apparent to the user.

One advantage of the beach towel modules of the present invention is that the shape of the connected beach towel modules often can be designed to meet the special needs of the group. For example, one embodiment of this invention includes connecting beach towel modules such that an open space is left in the middle of a series of attached towels. Other blanket shapes and designs are contemplated by this invention also.

A detachable beach towel is comprised of at least two beach towel modules. The preferred material for the beach towel modules is an absorbent fabric, such as terry cloth. The preferred shape of a beach towel module is rectangular. The principles of this invention can be applied to other shapes, as well.

Figure 1:
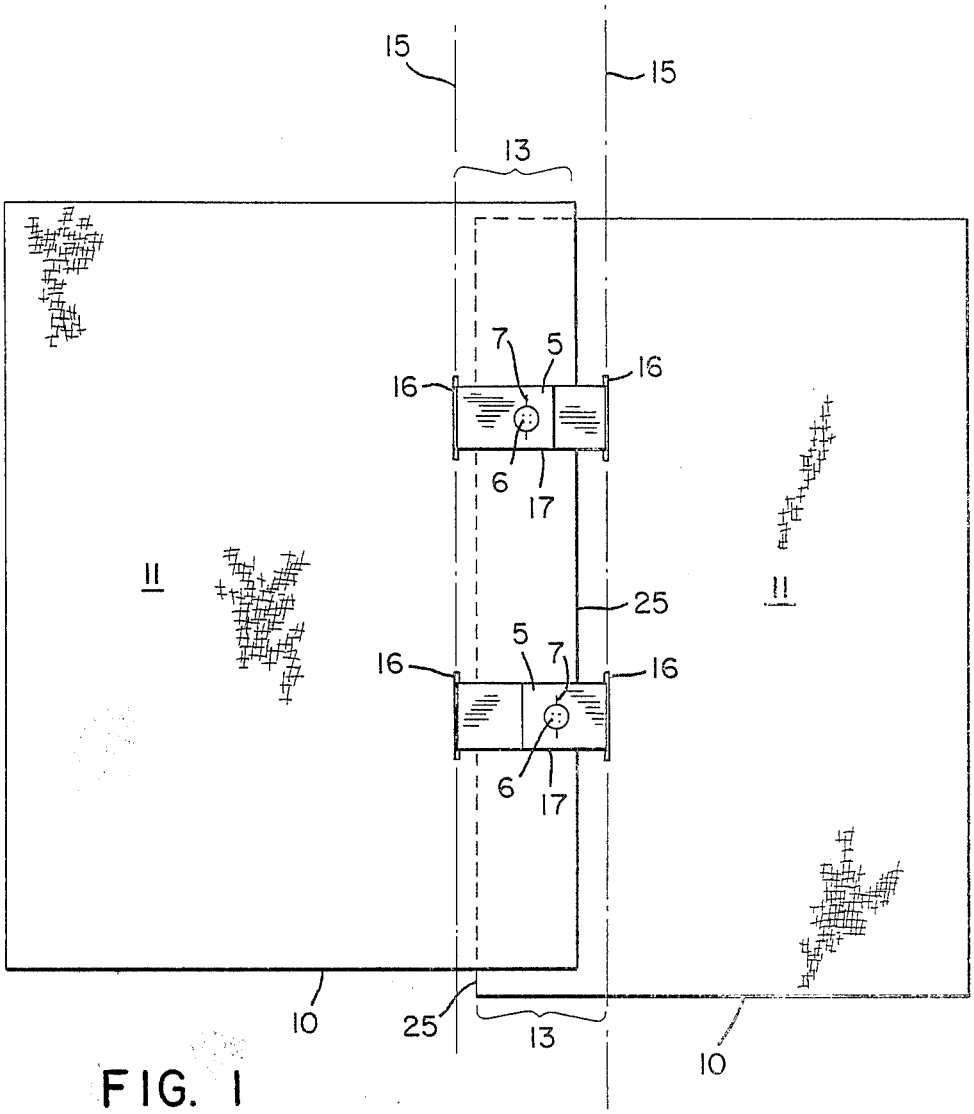
FIG. 1 shows a first beach towel module connected to a second beach towel module by two flexible members according to this invention.

In FIG. 1, a first beach towel module is shown connected to a second beach towel module according to this invention. Each beach towel module (10) contains at least two regularly-spaced linear openings. A linear axis is defined by the linear openings and extends parallel to the nearest outermost edge (25) of a beach towel module.

The detachable beach towel is further comprised of at least two flexible members (17) which connect the linear openings of the first beach towel module to respective aligned linear openings of the second beach towel module. One flexible member is inserted between each corresponding linear opening of the first beach towel module, and the second beach towel module of the sides to be connected together. Generally, the space (13) between the linear axis and the corresponding outermost edge is overlapped when the towels are joined together. See, FIG. 2.

Figure 2:
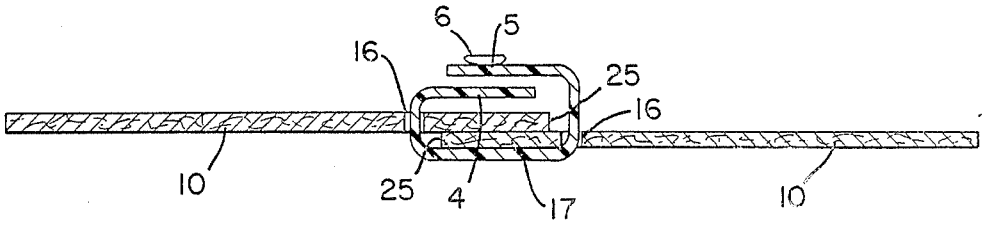
FIG. 2 shows a side view of a first beach towel module connected to a second beach towel module.
Figure 3:
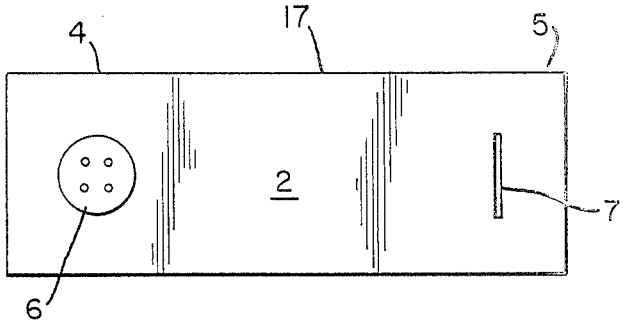
FIG. 3 shows a flexible member of this invention.

The flexible member (17) can be made from materials such as fabric, plastic, rubber and the like. A detailed flexible member is shown in FIG. 3. It consists of an elongated flexible body (2) having complementary connecting means positioned at the ends such that a first end (4) of the flexible body may be attached, and subsequently detached, to the second end (5) of the flexible body. FIG. 2. It is preferred that the flexible member have a uniform width which is equal to, or slightly less than, the length of the linear opening. The complementary connecting means must be capable of ready connection or detachment. Examples of suitable complementary connecting means include male and female snaps, button (6) and buttonhole (7), hooks and loops such as the ones sold under the trademark of Velcro, and hook and eye fasteners (or visa versa). It should be apparent that the placement of the connecting means at each respective end will be determined by the type of connection means chosen. Generally, the connecting means must be placed on opposite sides of the flexible members. Other suitable connecting means will be apparent from the above.

In order to minimize any interference of the flexible members with the user, the space (13) between a linear axis (15) and the corresponding outermost edge (25) should be as narrow as possible without allowing air, sand, dirt, grass or other undesired materials to work their way through an opening in the connected towels. The center area of the beach towel module (11) should be as large as possible. Placing the linear openings approximately one inch to three inches from the closest outermost edge should be sufficient. The measurement for placement of the linear openings should be predetermined to assist in the connection of various beach towel modules together. The space between a linear axis and its outermost edge can be folded or bunched in order to align at least two linear openings along the sides to be connected. It is preferred that the measurement for placement of the linear openings and the length of the flexible members be predetermined so that the beach towel modules overlap at the connected sides and lay flat. An equal overlap at the edge of each beach towel modules is preferred. A preferred measurement for placement of the linear openings is about one and one-half inch from the outermost edge.

The flexible member should be chosen from a material to lay as flush as possible with the overlapped beach towel areas to reduce any interference to the user of the connected beach towel module. For this reason, the preferred material for the flexible member is fabric; the most preferred is an absorbent towel fabric. A preferred connecting means is hooks and loops.

The linear openings are shaped as slits in the beach towel modules. The lengths of the linear openings should be large enough to accommodate the flexible member inserted therethrough. The width of the flexible member must be less than the shortest linear opening. The lengths should be predetermined to assist in the connection of various beach towel modules to one another. One preferred embodiment is to have the length of each linear opening approximately one-half inches to about five inches. Each linear opening preferably has a length of about one inch.

In a preferred embodiment, the linear openings are reinforced by protective threading, plastic, or the like, such that the fabric of the beach towel will not suffer tear or fray when a flexible connecting member is inserted therethrough. Some beach towel fabrics may not need external reinforcement if the fabric will not ravel upon repeated insertion of the flexible member.

The linear openings are regularly spaced in relationship with each other along their linear axis. As noted before, at least two linear openings are required for each side. It is preferred that each side have more than two linear openings per side.

In one embodiment, each linear opening should be positioned in the center of equal halves of the inner axis. In a different embodiment, an agreed distance 'X' is chosen for spacing the linear openings. This will allow for the ready alignment of the linear openings.

As a preferred embodiment, a system of regularly-spaced linear openings, based upon a standard 60 inch by 30 inch towel, can allow for the ready alignment of the linear openings of beach towel modules in many configurations. Along each 60-inch side, six one-inch linear openings are positioned nine inches apart so that each half of the inner edge is identical. Along each 30-inch side, three one-inch linear openings are positioned nine inches apart, again, so that each half of the inner edge is identical. This embodiment necessarily contemplates that one linear opening will be positioned in the direct center of the inner edge of each 30-inch side. With this embodiment, flexible members of approximately four inches long are contemplated of approximately one-inch wide, and have the respective complementary connecting means centered about one-half inch from each end.

Figure 4:
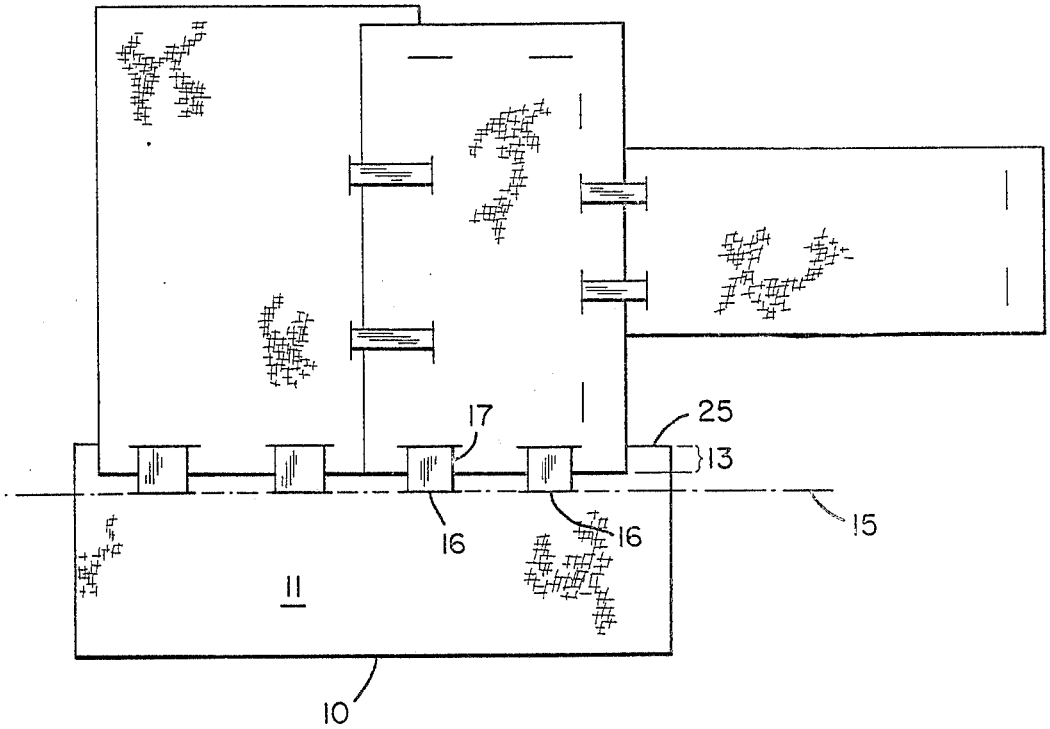
FIG. 4 shows several beach towel modules connected together according to this invention.

FIG. 4 depicts four beach towel modules (10) connected in accordance with the principles of this invention to demonstrate some attachment configurations possible with this invention.

What is claimed is:

1. A detachable beach towel system, adapted to underlie a substantial portion of a human body, comprising:

a first beach towel module and at least one different beach towel module, wherein each beach towel module contains at least two regularly-spaced linear openings parallel to at least one outermost edge, said at least two regularly-spaced linear openings define a linear axis which extends parallel to said outermost edge, at least two flexible members, wherein each flexible member terminates in a first end and a second end, said ends being provided with complementary connecting means capable of being readily detached, the width of said flexible member being less than the length of said regularly-spaced linear openings, A first end of a flexible member extending through a first linear opening of said first beach towel module and a second end of said flexible member extending through a first linear opening of a different beach towel module, said first and second ends of said flexible member being connected;

a first end of a different flexible member extending through a second linear opening of said first beach towel module said second linear opening of said first beach towel module being found in the same linear axis as said first linear opening of said first beach towel module, and a second end of said flexible member extending through a second linear opening of said different beach towel module, said second linear opening of said different beach towel module being found in the same linear axis as said first linear opening of said different beach towel module, said first and second ends of said flexible member being connected, whereby said first beach towel module attached to said different beach towel module is capable of ready detachment by the release of said complementary connecting means of connected flexible members.

2. The detachable beach towel of claim 1 wherein each linear axis is the same distance from the corresponding outermost edge.

3. The detachable beach towel of claim 2 wherein the length of each flexible member is at least twice the distance from a linear axis to the corresponding outermost edge.

4. The detachable beach towel of claim 1 wherein said beach towel modules are rectangularly-shaped.

5. The detachable beach towel of claim 4 wherein said beach towel modules are of the same size.

6. The detachable beach towel of claim 1 wherein said linear openings are reinforced.

7. The detachable beach towel of claim 1 wherein at least one of said complementary connecting means, capable of being readily detached, is a hook and loop type fastener.

8. The detachable beach towel of claim 1 wherein at least one of said complementary connecting means, capable of being readily detached, is a button and buttonhole type fastener.

9. A method of increasing the surface area of a beach towel comprising the steps of:

a. aligning, in direct opposing relationship, at least two regularly-spaced linear openings of a first beach towel module with at least two regularly-spaced linear openings of a different beach towel module, wherein each beach towel module contains at least two regularly-spaced linear openings parallel to at least one outermost edge, said at least two regularly-spaced linear openings defining a linear axis which extends parallel to said outermost edge, b. inserting a first end of a flexible member through an aligned linear opening of said first beach towel module, and a second ed of said flexible member through the corresponding aligned linear opening of said different beach towel module, said flexible member terminating in a first end and a second end, said ends being provided with complementary connecting means capable of being readily detached, the width of said ends being less than the length of said reinforced linear openings;

c. connecting said first end of said flexible member to said second end of said flexible member;

d. repeating steps a., b., and c. at a second aligned reinforced linear opening of said first beach towel module and of said different beach towel module;

whereby the size of a beach towel is increased.

10. A method of claim 9 whereby an additional beach towel module is connected to said first beach towel module.

11. A method of claim 9 whereby an additional beach towel module is connected to said first beach towel module and said different beach towel module.

* * * * *